US005643066A

United States Patent [19]

Vermillion

[11] Patent Number: 5,643,066

[45] Date of Patent: Jul. 1, 1997

[54] FIXTURE FOR SKI EDGE FINISHING TOOL

[76] Inventor: James H. Vermillion, 14220 Orchard Ave., Caldwell, Id. 83605

[21] Appl. No.: 678,720

[22] Filed: Jul. 11, 1996

[51] Int. Cl.[6] ..... B24B 21/18

[52] U.S. Cl. ..... 451/442; 76/83; 76/88

[58] Field of Search ..... 83/821; 451/45, 451/321, 371, 383, 556, 322; 76/83, 88, 82.2, 82; 29/78–81

[56] References Cited

U.S. PATENT DOCUMENTS

| | | | |
|---|---|---|---|
| 3,875,825 | 4/1975 | Buttafucco | 76/88 |
| 3,934,287 | 1/1976 | Howard | 7/14.1 R |
| 3,991,429 | 11/1976 | Honauer | 7/14.1 R |
| 4,030,382 | 6/1977 | Nilsson et al. | 76/83 |
| 4,060,013 | 11/1977 | Thompson | 76/83 |
| 4,089,076 | 5/1978 | Sparling | 7/14.1 R |
| 4,189,874 | 2/1980 | Labriola | 51/181 R |
| 4,241,624 | 12/1980 | Strojny | 76/83 |
| 4,630,409 | 12/1986 | Hofstetter | 51/361 |
| 4,998,956 | 3/1991 | Sherman | 76/83 |
| 5,400,679 | 3/1995 | Hawker | 76/83 |
| 5,445,050 | 8/1995 | Owens | 76/83 |
| 5,485,768 | 1/1996 | Vermillion | 76/83 |
| 5,499,555 | 3/1996 | Vermillion | 76/83 |
| 5,569,064 | 10/1996 | Gleadall | 76/83 |

*Primary Examiner*—James G. Smith
*Assistant Examiner*—Derris H. Banks
*Attorney, Agent, or Firm*—Joseph W. Holland

[57] ABSTRACT

A fixture for positioning a file or other abrasive finishing tool relative to the running surface of the ski so that the bottom face of the ski edge may be beveled. The fixture is configured to allow either or both the angle and the width of the bottom face of the edge that is finished to be varied.

23 Claims, 3 Drawing Sheets

FIXTURE FOR SKI EDGE FINISHING TOOL

BACKGROUND OF THE INVENTION

1. Technical Field

This invention relates generally to ski maintenance equipment and more specifically to a guide for holding and positioning a file or other abrasive device to hold the cutting or other abrasive face in a predetermined plane relative to the bottom running face of the ski and therefore the edge of the ski for controlling the angle at which the edge of the ski is finished and/or the width of the metal edge which is finished.

2. Background

The craft of maintaining and preparing skis for use, both by recreational skiers and racers, has evolved to a relatively advanced state. The expectations of both the skier and the maintenance personnel regarding the performance of the ski as a result of tuning has increased dramatically over the last several years. Both the bases and the edges of skis are tuned to exacting specifications depending upon the intended use by the skier. Specifically, the base of the ski is oftentimes ground and polished to assure a flat and smooth running base. Skies are often treated with waxes which are chosen based upon ambient temperatures and conditions as well as snow surface temperature and condition.

Similarly, the edges of a ski which provide the control required by a skier to turn the ski may be milled and filed to exacting specifications depending upon the intended use of the ski. For instance, an aggressive skier may prefer to have the edges filed perfectly flat relative to the base of the ski. Racers who compete in slalom racing, which requires turns having the tightest radius may prefer to have the bottom face of the metal edge of the ski beveled at one-half of one degree relative to the flat running surface of the ski. Giant slalom skiers may prefer to have the bottom face of the metal edge of the ski beveled at one degree relative to the flat running surface of the ski. Skiers who race in the super-G event may prefer a ski having the bottom face of the metal edge of the ski beveled at one and one-half degrees relative to the flat running surface of the ski. Downhill skiers, who typically ski at higher speeds, carving longer radius turns, would option to have the bottom face of the metal ski edge beveled in the two degree range relative to the flat running surface of the ski, allowing the skier to angulate the upper portion of his body to a greater extent before the edge of the ski initiates carving of the turn. Finally, skiers may opt to tune their skis to have compound bevels or bevels that vary along the length of the ski.

The object, then, of edge tuning and sharpening has evolved significantly, however, it continues to be an object of the edge sharpening procedure to create a consistently smooth, sharp edge having a side edge portion which is substantially perpendicular to the running base of the ski and a bottom face of the metal ski edge which is cut at anywhere from zero degrees, or parallel to the running base of the ski, to five or seven degrees as desired by the skier, or required by the conditions.

Ski tuning may be performed in ski shops, where the technician is likely to have a work bench and a means, typically a vise, for holding the ski secured in a predetermined orientation, typically with the base up. Alternately, ski tuning may be done at the last minute on the ski slope or just prior to a race, depending on existing or changing conditions. Additionally, ski tuning is performed by individuals having a range of experience, including well trained and seasoned individuals to those who have had relatively no experience or who may be simply seasonal employees.

Numerous devices have been disclosed for sharpening the side of the metal edge of a ski. Among these are Honauer, U.S. Pat. No. 3,991,429, Apparatus for Sharpening Edges of Skis, Sparling, U.S. Pat. No. 4,089,076, Ski Servicing and Repair Tool, and Labriola, U.S. Pat. No. 4,189,874, Hand Held Pocket Sized Ski Repair and Maintenance Tool.

Other tools and fixtures have been disclosed which provide a means for filing both the vertical side face of the metal edge and the bottom face of the metal edge. Sherman, U.S. Pat. No. 4,998,956, Ski and Snow board Sharpener, discloses a sharpener for sharpening the vertical and horizontal metallic edge surfaces of a ski or snow board.

Howard, U.S. Pat. No. 3,934,287, Combination Ski Maintenance Tool, discloses a tool or fixture for holding a file for flat filing the running base of a ski. Nilsson, et. al., U.S. Pat. No. 4,030,382, Sharpening Device for Steel Ski Edge Strips, discloses a tool for sharpening the side face of the metal edge of a ski and provides means for bending the file blade to limit the cutting action to a few teeth at a time.

Strojny, U.S. Pat. No. 4,241,624, Edge Sharpener, discloses a device for holding a file which may be used to file either the side face of the metal edge or the bottom face of the metal edge. Hofstetter, U.S. Pat. No. 4,630,409, discloses a device for finishing the edges of a ski which has a base plate which moves along the base of the ski with a pair of blocks having finishing surfaces disposed on either side of the base plate for simultaneously finishing the bottom face of either of the two metal edges of the ski.

Finally, Vermillion, U.S. Pat. No. 5,485,768, Ski Sharpening Guide, claims a ski sharpening guide for use with a file for sharpening the edges of a ski.

While the above referenced devices serve a variety of purposes relative to the craft of ski tuning and finishing, what is needed is a simple hand held fixture for positioning and orienting a file or other finishing tool at a predetermined height and a predetermined angle relative to the running base of the ski and therefore the metal edge of the ski for finishing the bottom face of the metal edge of the ski at a predetermined angle relative to the flat running base of the ski and/or at a predetermined width from the marginal edge of the ski.

Another object of the present invention is to provide a fixture for holding or positioning a file which allows both the height and the angle at which the file is held relative to the running base of the ski to be adjusted.

Another object of the present invention is to provide a fixture for positioning and orienting a file or other finishing tool at a predetermined height and angle relative to the running base of the ski which is simple to index against the running base and the marginal side of the ski so that a relatively untrained individual is capable of producing and repeating consistent results.

SUMMARY OF THE INVENTION

According to the present invention, these and other objects are achieved by a fixture for positioning an abrasive tool for finishing a ski edge so that the bottom face of the ski edge is beveled relative to the running surface of the ski. The fixture has a pair of arm members which lie in parallel spaced apart relationship, The preferred embodiment of the invention also includes a tool shim having a top face, a bottom face, and a predetermined thickness, extending between the second ends of the arm members. When the fixture is in use, the tool shim top face lies in a plane parallel to the running surface of the ski with the plane of the top face of the tool shim located at a higher elevation than the elevation of the running surface of the ski. The tool shim is configured so that its bottom face may be held in sliding contact with the running surface of the ski at a predetermined and fixed distance from the marginal side of the ski. An abrasive tool, such as a file, is held at a predetermined angle relative to the running surface of the ski.

The preferred embodiment of the invention also includes a cross member attached near the first end of the first arm member and the first end of the second arm member, extending between the first and second arm members. In the preferred embodiment of the invention, the cross member serves as a tool stop. The tool stop has a top face lying in a plane which is at a lower elevation than the elevation of the running surface of the ski and parallel thereto. The angle at which the abrasive tool or file lies at relative to the running surface of the ski is determined by the difference in elevation between the top face of the tool stop and the top face of the tool shim.

The preferred embodiment of the invention also has an indexing mechanism attached to the fixture for indexing the fixture against the marginal side of the ski. In the preferred embodiment of the invention, the indexing mechanism is a pair of elevators located near the first ends of the pair of arm members. Each of the elevators has a running surface indexing face which lies in a plane parallel to the running surface of the ski when the fixture is in use, and a marginal side indexing surface which lies substantially parallel to the marginal side of the ski and serve to hold the tool shim at a predetermined and fixed distance from the marginal side of the ski when the fixture is in use.

In the preferred embodiment of the invention, the elevators are fabricated from a nylon, plastic or Teflon material which allows the fixture to slide easily along the length of the ski allowing the fixture to accurately engage and index against running face and the side of the metal edge of the ski.

In the preferred embodiment of the invention, each of the elevators, the tool stop and the tool shim are removable and interchangeable. This combination of features allow both the angle and the width of the bottom face of the edge that is finished to be varied. Specifically, the relative difference in elevation between top face of the tool stop and the top face of the tool shim determines the angle at which the finishing tool is held relative to the running surface of the ski and therefore the edge being finished. The angle of the bevel may be varied by removing the tool shim and replacing it with a tool shim of greater or lesser thickness. Similarly, the relative difference in elevation between the running surface indexing face of the elevator and the bottom face of the tool shim determine the width of the bevel angle. The width of the bevel is varied by removing the elevator and interchanging it with an elevator that provides a relatively greater or lesser elevation of the running surface indexing face relative to the running base of the ski.

Alternately, the fixture may be offered to the user in a fixed version wherein the elevators, the tool stop and the tool shim are not removable and interchangeable. In this embodiment, a variety of tools having different fixed configurations would be manufactured and offered for use to provide a variety of bevel angles and widths.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
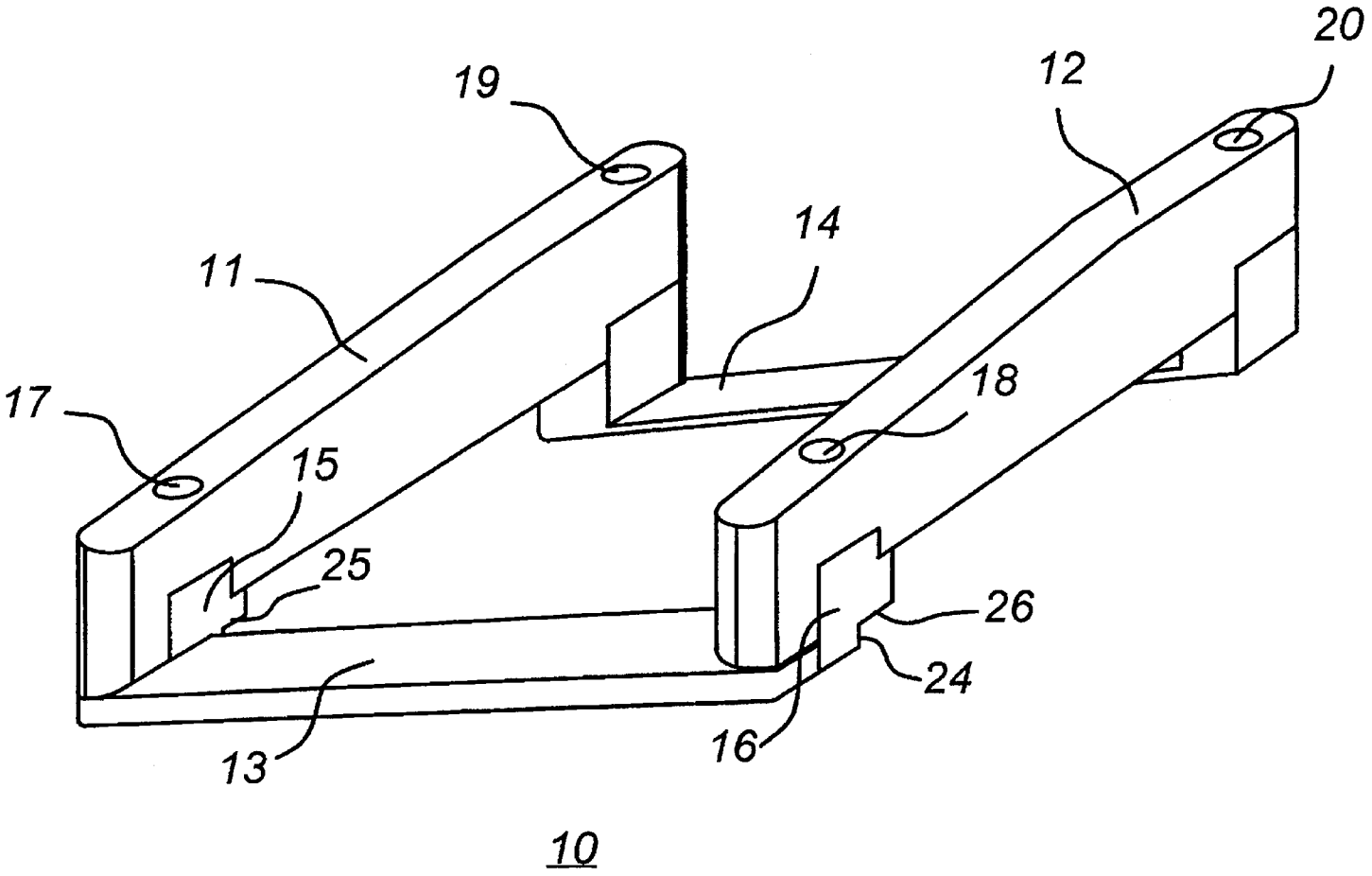
FIG. 1 is an orthographic representational view of the preferred embodiment of the present invention.
Figure 3:
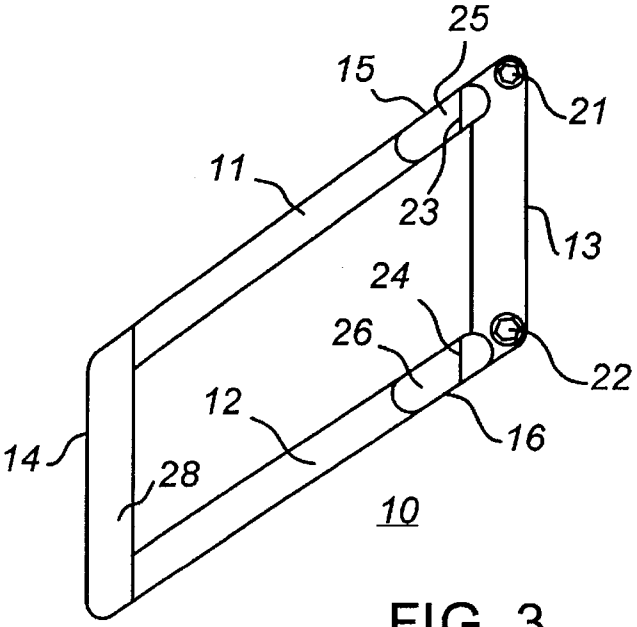
FIG. 3 is a bottom elevational view of the preferred embodiment of the present invention.
Figure 2:
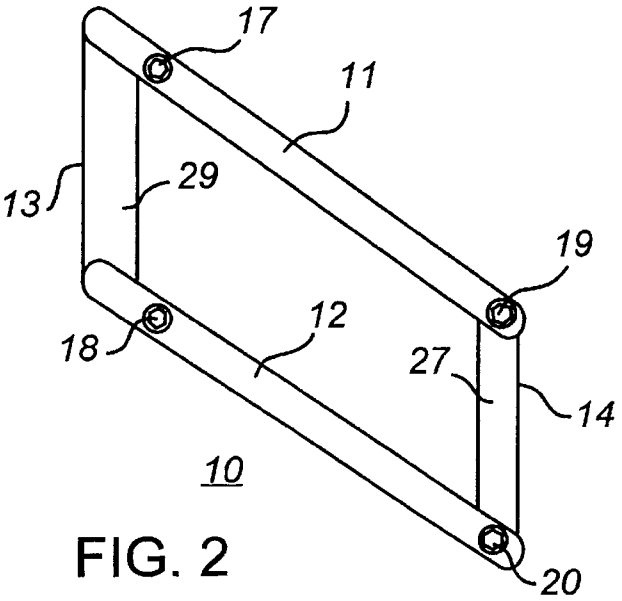
FIG. 2 is a top elevational view of the preferred embodiment of the present invention.
Figure 4:
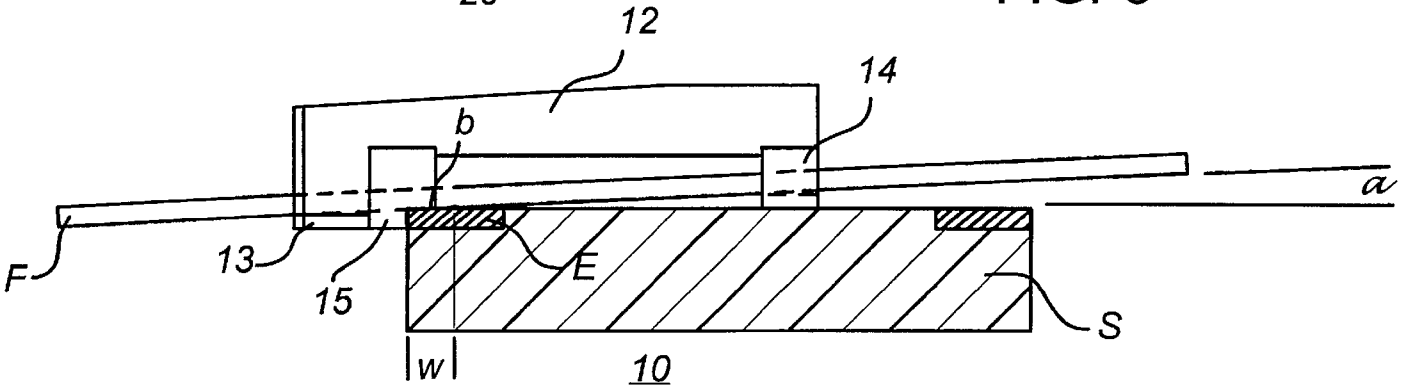
FIG. 4 is a side elevational view of the preferred embodiment of the present invention.
Figure 5:
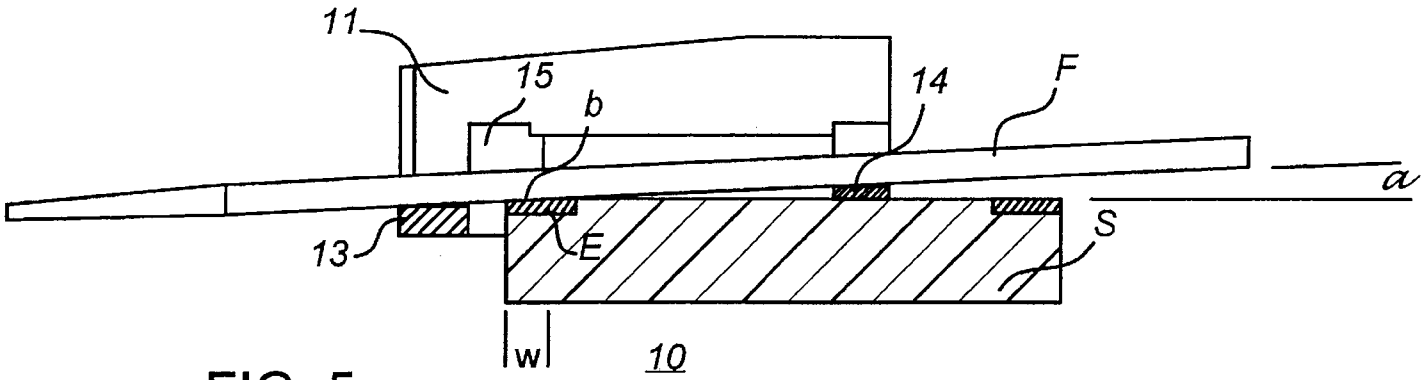
FIG. 5 is a side elevational view detail of the preferred embodiment of the present invention.
Figure 6:
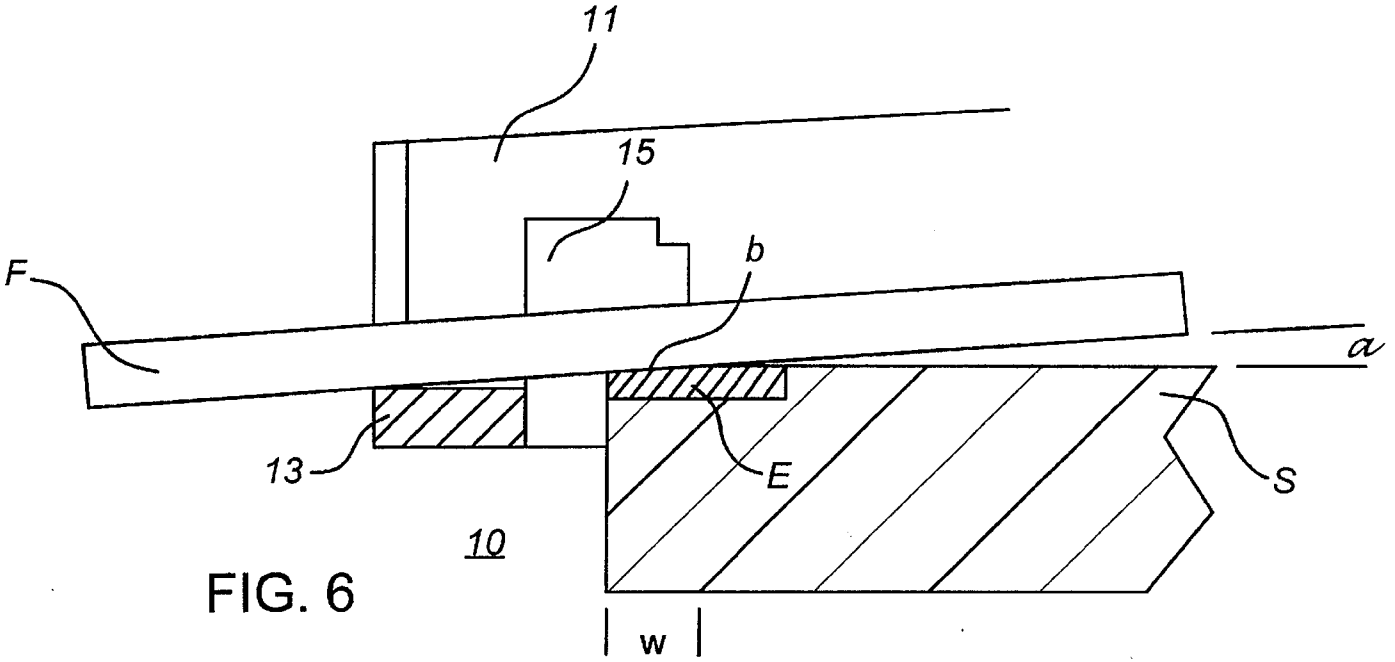
FIG. 6 is a side elevational view detail of the preferred embodiment of the present invention.

Referring now to FIGS. 1 through 6, the fixture for positioning an abrasive tool for finishing a ski edge will be more fully described and understood. In the preferred embodiment of the invention, fixture 10 has a pair of arm members, first arm member 11 and second arm member 12 which lie in parallel spaced apart relationship. Tool stop 13 is removably attached to the lower edge of and extends between the first end of first arm member 11 and the first end of second arm member 12 by screws 21 and 22. Tool shim 14 is removably attached to the lower edge of and extends between the second end of first arm member 11 and the second end of second arm member 12 by screws 19 and 20.

Elevator 15 is removably attached to the lower edge, near the first end of arm member 11 by screw 17. Similarly, elevator 16 is removably attached to the lower edge, near the first end of arm member 12 by screw 18.

Elevator 15 is configured having running surface indexing face 25 and marginal side indexing surface 23. Similarly, elevator 16 is configured having running surface indexing face 26 and marginal side indexing surface 24.

In use, fixture 10 is positioned relative to ski S by placing bottom face 28 of tool shim 14 against the running face of ski S. Running surface indexing face 25 of elevator 15 is placed against the running face of ski S and marginal side indexing surface 23 is placed against the marginal side of ski S and edge E. Similarly, running surface indexing face 26 of elevator 16 is placed against the running face of ski S and marginal side indexing surface 24 is placed against the marginal side of ski S and edge E.

An abrasive tool for finishing, in this case file F is placed in fixture 10, bridging between tool stop 13 and tool shim 14 so that a first end of the cutting face of file F lies against top face 27 of tool shim 14 and the second end of file F lies against top face 29 of tool stop 13. In the preferred embodiment of the invention, fixture 10 is configured so that the included angle between tool stop 13 and first arm member 11 is between thirty and sixty degrees. This configuration allows, when the fixture is in use, the second end of fixture 10, or that end to which tool shim 14 is attached, to lead ahead of the first end, or that end to which tool stop 14 is attached. Inasmuch as the teeth of a mill bastard or mill file are angled at approximately sixty-five degrees relative to the longitudinal axis of the file, this configuration allows file F to be readily positioned in fixture 10 to allow optimal cutting.

In the preferred embodiment of the invention, the included angle α formed between file F and the running base of ski S may be modified by removing screws 19 and 20 which secure tool shim 14 to fixture 10 and replacing with a shim having a thinner or thicker cross section. In the preferred embodiment of the invention, tool shim 14 is provided in a variety of thicknesses ranging from 1 to 5 mm. It is to be appreciated that the relative difference in elevation between top face 29 of tool stop 13 and top face 27 of tool shim 14 determines the included angle α formed between file F and the running base of ski S. Similarly, for any given included angle α, the width W of bevel b is a function of the relative difference in elevation between bottom face 28 of tool shim 14 and running surface indexing face 25 of elevator 15 running surface indexing face 26 of elevator 16.

Alternatively, as is the case in the embodiment which does not use a tool stop/cross member, the included angle is simply a function of the thickness of the tool shim as compared to the distance the shim is positioned from the ski edge. Mathematically, this is expressed as the tangent inverse of the ratio of the thickness of the tool shim to the horizontal distance the shim is away from the inside of the beveled ski edge. It should be noted that for an embodiment which does use the tool stop the ratio of the vertical distance between the top surface of the tool stop and the tool shim to the horizontal distance from the front edge of the tool shim to the front edge of the tool stop is equal to the ratio mentioned above for the embodiment without the tool stop. Hence, the included angle for the embodiment which uses the tool stop is equal to the tangent inverse of the ratio of the vertical distance between the top surface of the tool stop and the tool shim to the horizontal distance from the front edge of the tool shim to the front edge of the tool stop While there is shown and described the preferred embodiment of the invention, it is to be distinctly understood that this invention is not limited thereto but may be variously embodied to practice within the scope of the following claims.

I claim:

1. A fixture for positioning an abrasive tool on the running surface of a ski for beveling a ski edge comprising:

a pair of arm members which lie in parallel spaced apart relationship;

a cross member attached near a first end of a first of the pair arm members and a first end of a second of the pair of arm members, the cross member extending between the first and second arm members;

an indexing mechanism for indexing the fixture against a marginal side of the ski;

a tool shim having a top face, a bottom face, and a predetermined thickness, extending between and attached to a second end of the first arm member and a second end of the second arm member, the tool shim top face lying in a plane parallel to the running surface of the ski, the plane of the top face of the tool shim having a higher elevation than the elevation of the running surface of the ski, the tool shim being configured so that the bottom face may be held in sliding contact with the running surface of the ski at a predetermined and fixed distance from the indexing mechanism, the tool shim being further configured so that the abrasive tool is held at an angle relative to the running surface of the ski.

2. The fixture of claim 1 wherein the cross member comprises a tool stop having a top face lying in a plane parallel to the running surface of the ski, the plane of the top face of the tool stop having a lower elevation than the elevation of the running surface of the ski.

3. The fixture of claim 2 wherein the angle at which the abrasive tool is held relative to the running surface of the ski is determined by the difference in elevation between the top face of the tool stop and the top face of the tool shim.

4. The fixture of claims 2 wherein the tool stop is removable and interchangeable.

5. The fixture of claim 1 wherein the indexing mechanism for indexing the fixture against the marginal side of the ski comprises a pair of elevators, a first elevator located near the first end of the first arm member and a second elevator located near the first end of the second arm member.

6. The fixture of claim 5 wherein each of the pair of elevators further comprise a running surface indexing face which lies in a plane parallel to the running surface of the ski when the fixture is in use, and a marginal side indexing surface which lies substantially parallel to the marginal side of the ski when the fixture is in use.

7. The fixture of claim 6 wherein each of the pair of elevators is fabricated from a material which allows the fixture to slide easily along the length of the ski and allows the fixture to accurately engage and index against running face and the side of the metal edge of the ski.

8. The fixture of claim 7 wherein the material is selected from the group of materials comprising plastic, nylon and Teflon.

9. The fixture of claim 5 wherein each of the pair of elevators are is removable and interchangeable.

10. The fixture of claims 5 wherein the abrasive tool is positioned to bevel the edge of the ski at a predetermined width, the width of the bevel being determined by the relative difference in elevation between the running surface indexing faces of the pair of elevators and the bottom face of the tool shim.

11. The fixture of claim 10 wherein the indexing mechanism for indexing the fixture against the marginal side of the ski comprises a pair of elevators, a first elevator located near the first end of the first arm member and a second elevator located near the first end of the second arm member.

12. The fixture of claim 11 wherein each of the pair of elevators further comprise a running surface indexing face which lies in a plane parallel to the running surface of the ski when the fixture is in use, and a marginal side indexing surface which lies substantially parallel to the marginal side of the ski when the fixture is in use.

13. The fixture of claim 12 wherein each of the pair of elevators is fabricated from a material which allows the fixture to slide easily along the length of the ski and allows the fixture to accurately engage and index against running face and the side of the metal edge of the ski.

14. The fixture of claim 13 wherein the material is selected from the group of materials comprising plastic, nylon and Teflon.

15. The fixture of claim 5 wherein each of the pair of elevators are is removable and interchangeable.

16. The fixture of claims 5 wherein the abrasive tool is positioned to bevel the edge of the ski at a predetermined width, the width of the bevel being determined by the relative difference in elevation between the running surface indexing faces of the pair of elevators and the bottom face of the tool shim.

17. The fixture of claims 1 wherein the tool shim is removable and interchangeable.

18. The fixture of claims 1 wherein the tool shim is removable and interchangeable.

19. A fixture for positioning an abrasive tool in relation to a running surface of a ski for beveling a ski edge comprising:

an arm member;

a cross member attached near a first end of a first of the pair arm members and a first end of a second of the pair of arm members, the cross member extending between the first and second arm members;

an indexing mechanism for indexing the fixture against the marginal side of the ski attached to the fixture; and a tool shim attached near a second end of the arm, extending from the arm, the tool shim having a top face, a bottom face, and a predetermined thickness, the tool shim top face lying in a plane parallel to the running surface of the ski, the plane of the top face of the tool shim having a higher elevation than the elevation of the running surface of the ski, the tool shim being configured so that the bottom face may be held in sliding contact with the running surface of the ski at a predetermined and fixed distance from the indexing mechanism, the tool shim being further configured so that the abrasive tool is held at an angle relative to the running surface of the ski.

20. The fixture of claim 19 wherein the cross member comprises a tool stop having a top face lying in a plane parallel to the running surface of the ski, the plane of the top face of the tool stop having a lower elevation than the elevation of the running surface of the ski.

21. The fixture of claim 20 wherein the angle at which the abrasive tool is held relative to the running surface of the ski is determined by the difference in elevation between the top face of the tool stop and the top face of the tool shim.

22. The fixture of claims 20 wherein the tool stop is removable and interchangeable.

23. A fixture for positioning an abrasive tool on the running surface of a ski for beveling a ski edge comprising:

an arm member;

a tool shim having a top face and a predetermined thickness, the shim being attached near a second end of the arm member, the tool shim top face positioned to lie in a plane parallel to the running surface of the ski and elevated with respect thereto when the fixture is applied to the ski; an indexing mechanism, being attached to the arm member, for indexing the fixture against a marginal side of the ski and positioning the tool shim at a predetermined distance from the indexing mechanism and thereby position an abrasive tool, held against the tool shim and the ski edge, at an angle relative to the running surface of the ski which is substantially equal to the inverse tangent of the quotient of the thickness divided by the predetermined distance.

* * * * *